US010133287B2

(12) United States Patent
Yang

(10) Patent No.: US 10,133,287 B2
(45) Date of Patent: Nov. 20, 2018

(54) SEMICONDUCTOR DEVICE HAVING OUTPUT COMPENSATION

(71) Applicant: Macronix International Co., Ltd., Hsinchu (TW)

(72) Inventor: Yih-Shan Yang, Hsinchu (TW)

(73) Assignee: Macronix International Co., Ltd., Hsinchu (TW)

( * ) Notice: Subject to any disclaimer, the term of this patent is extended or adjusted under 35 U.S.C. 154(b) by 150 days.

(21) Appl. No.: 14/960,657

(22) Filed: Dec. 7, 2015

(65) Prior Publication Data

US 2017/0160757 A1 Jun. 8, 2017

(51) Int. Cl.
*G05F 1/40* (2006.01)
*G05F 1/575* (2006.01)

(52) U.S. Cl.
CPC ..... *G05F 1/575* (2013.01)

(58) Field of Classification Search
CPC ..... G05F 1/575; G05F 3/262
USPC ..... 323/271–285; 330/59, 282, 308
See application file for complete search history.

(56) References Cited

U.S. PATENT DOCUMENTS 6,556,083 B2 * 4/2003 Kadanka ..... H03F 1/086 330/109
7,173,402 B2 * 2/2007 Chen ..... G05F 1/575 323/274
7,986,188 B2 * 7/2011 Fujiwara ..... H03F 1/086 323/316
8,169,203 B1 * 5/2012 Vemula ..... G05F 1/575 323/273
8,242,761 B2 * 8/2012 Napravnik ..... G05F 1/575 323/280
8,482,266 B2 * 7/2013 Yu ..... G05F 1/575 323/280

* cited by examiner

*Primary Examiner* — Rajnikant Patel
(74) *Attorney, Agent, or Firm* — Finnegan, Henderson, Farabow, Garrett & Dunner LLP

(57) ABSTRACT

A semiconductor device includes an amplifier, a pass transistor, a compensation circuit, and a bias voltage generator. The amplifier has an output terminal. The pass transistor has a gate and an output terminal. The gate is coupled to the output terminal of the amplifier, and the output terminal of the pass transistor is coupled to a load. The compensation circuit is coupled between the output terminal of the amplifier and the output terminal of the pass transistor. The compensation circuit has a variable impedance. The bias voltage generator is coupled between the output terminal of the pass transistor and the compensation circuit.

20 Claims, 7 Drawing Sheets

600

700

SEMICONDUCTOR DEVICE HAVING OUTPUT COMPENSATION

TECHNOLOGY FIELD

The disclosure relates to a semiconductor device having output compensation and, more particularly, to a semiconductor device having stability over a wide current load range.

BACKGROUND

Semiconductor devices having an electronic amplifier are widely used for voltage regulation. For example, a low drop-out (LDO) regulator, which includes an error amplifier, can be used in a system-on-chip (SOC) or a memory system for power management. Hereinafter, a device or circuit having an electronic amplifier is also referred to as an amplifier circuit.

An amplifier circuit may have a property called a "pole", which can be deduced from a transfer function of the amplifier circuit. Some amplifier circuits, such as the LDO regulator or a unity gain buffer, have at least one pole, such as an output pole at the output stage of the amplifier circuit. To realize stable operation, the output pole should be compensated. The location, i.e., the frequency, of the output pole depends on a load current of the amplifier circuit. Generally, the load current of the amplifier circuit can vary over a wide range due to, for example, change of the load, and thus the output pole may shift when the load changes. As a result, compensation for the output pole at a certain load may not work well for a different load.

SUMMARY

In accordance with the disclosure, there is provided a semiconductor device including an amplifier, a pass transistor, a compensation circuit, and a bias voltage generator. The amplifier has an output terminal. The pass transistor has a gate and an output terminal. The gate is coupled to the output terminal of the amplifier, and the output terminal of the pass transistor is coupled to a load. The compensation circuit is coupled between the output terminal of the amplifier and the output terminal of the pass transistor. The compensation circuit has a variable impedance. The bias voltage generator is coupled between the output terminal of the pass transistor and the compensation circuit Also in accordance with the disclosure, there is provided a semiconductor device including an amplifier, a pass transistor, a compensation transistor, a current sensor, and a bias voltage generator. A gate of the pass transistor is coupled to an amplifier output terminal of the amplifier, and one of a source or drain of the pass transistor is coupled to a device output terminal of the semiconductor device. The compensation transistor is coupled between the amplifier output terminal and the device output terminal. The current sensor is coupled to the gate of the pass transistor and configured to sense a load current of the semiconductor device. The bias voltage generator is coupled between a gate and a source of the compensation transistor, and is configured to generate a compensation control signal to adjust a resistance of the compensation transistor based on the sensed load current.

Features and advantages consistent with the disclosure will be set forth in part in the description which follows, and in part will be obvious from the description, or may be learned by practice of the disclosure. Such features and advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Embodiments consistent with the disclosure include a semiconductor device having output compensation.

Hereinafter, embodiments consistent with the disclosure will be described with reference to the drawings. Wherever possible, the same reference numbers will be used throughout the drawings to refer to the same or like parts.

Figure 1:
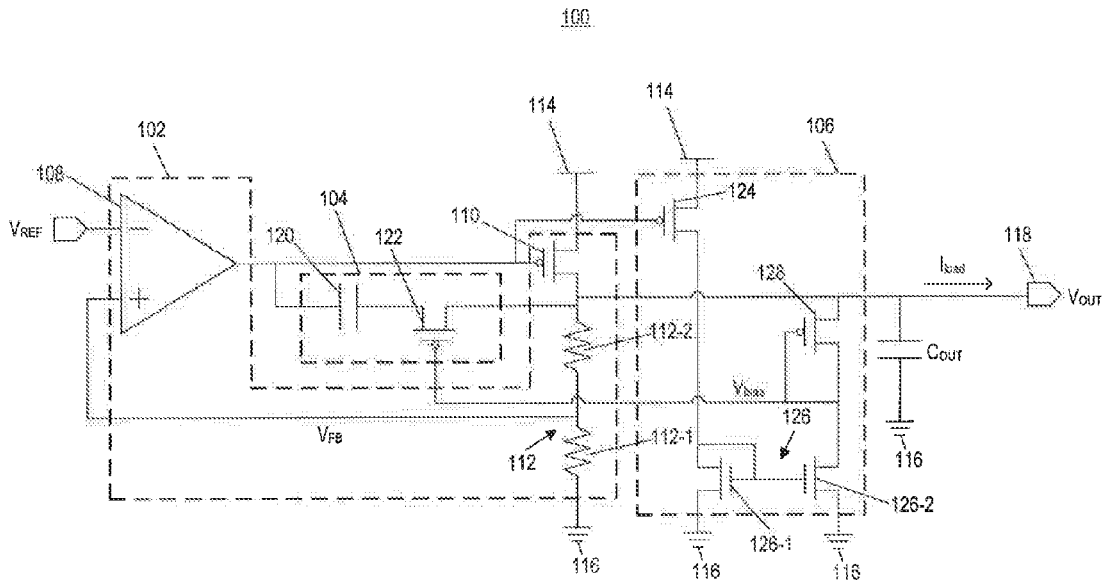
FIG. 1 is a circuit diagram of a semiconductor device according to an exemplary embodiment.

FIG. 1 shows an exemplary semiconductor device 100 consistent with embodiments of the present disclosure. In the example shown in FIG. 1, the semiconductor device 100 is a low drop-out (LDO) regulating device. As shown in FIG. 1, the semiconductor device 100 includes a voltage regulator 102, a compensation circuit 104, and a compensation control circuit 106.

The voltage regulator 102 includes an error amplifier 108, a pass transistor 110, and a voltage divider 112 containing a first resistor 112-1 and a second resistor 112-2. The pass transistor 110 and the voltage divider 112 are connected in series, and coupled between a power supply 114 and a ground 116. As shown in FIG. 1, a negative input terminal of the error amplifier 108 is coupled to a reference voltage $V_{REF}$, a positive input terminal of the error amplifier 108 is coupled to a mid-point between the first and second resistors 112-1 and 112-2 to receive a feedback voltage $V_{FB}$, and an amplifier output terminal of the error amplifier 108 is coupled to a gate of the pass transistor 110. In the example shown in FIG. 1, the pass transistor 110 is a p-channel metal-oxide-semiconductor (PMOS) transistor. In some embodiments, the pass transistor 110 may be a different type of transistor, such as an n-channel MOS (NMOS) transistor. A source of the pass transistor 110 is coupled to the power supply 114 and a drain of the pass transistor 110 is coupled to the second resistor 112-2. In the present disclosure, the source and drain of a transistor are each also referred to as an "output terminal" of the transistor. An output voltage $V_{OUT}$ at a coupling point between the drain of the pass transistor 110 and the second resistor 112-2 is output from an output terminal 118 of the voltage regulator 102. This output terminal 118 is also referred to as an "LDO output terminal."

Figure 2:
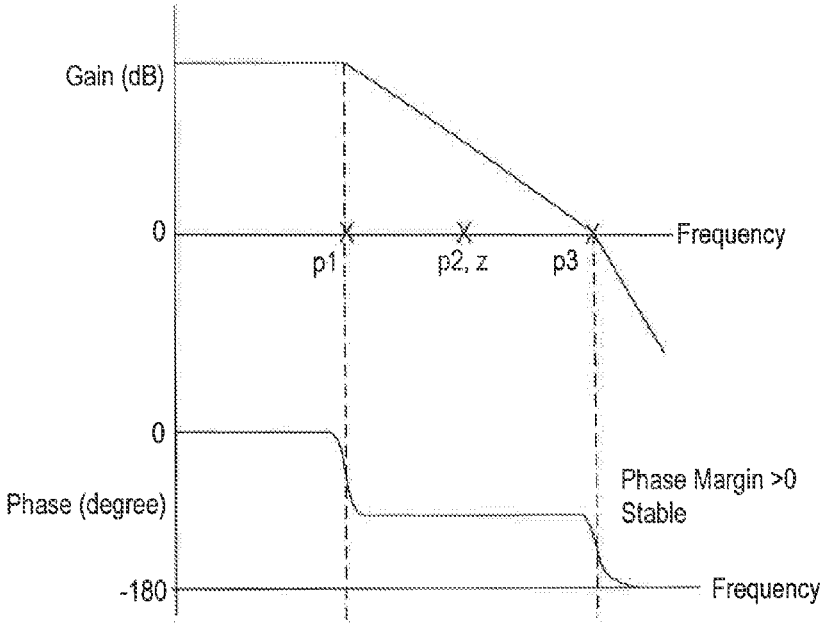
FIG. 2 schematically shows a Bode plot of a semiconductor device consistent with embodiments of the present disclosure.

The compensation circuit 104 is coupled between the amplifier output terminal of the error amplifier 108 and the LDO output terminal 118, and includes a compensation capacitor 120 and a compensation transistor 122. In the example shown in FIG. 1, the compensation transistor 122 is a PMOS transistor. The impedance or resistance of the compensation transistor 122 can be adjusted by controlling a bias voltage applied to a gate of the compensation transistor 122, so that the compensation transistor 122 is configured as and functions as a variable impedance device or a variable resistor. In some embodiments, the compensation transistor 122 may be a different type of transistor, such as an NMOS transistor. The compensation circuit 104 is configured to add a zero at a frequency about the same as the frequency of the output pole of the voltage regulator 102 so as to cancel the output pole. FIG. 2 shows a Bode plot illustrating the cancelling of the output pole. The Bode plot includes a Bode gain plot in the upper pane and a Bode phase plot in the lower pane.

As shown in FIG. 2, the voltage regulator 102 has two poles, i.e., the output pole "p2", which is also referred to as a "non-dominant pole," and another pole "p1", which is also referred to as a "dominant pole," at a frequency lower than the output pole "p2". The zero "z" introduced by the compensation circuit 104 is at about the same frequency as the output pole "p2" of the voltage regulator 102. As such, the output pole "p2" is canceled and the slope of the Bode gain plot does not have a sudden change at the frequency corresponding to the output pole "p2". In practice, the zero "z" introduced by the compensation circuit 104 may not exactly overlap with the output pole "p2", i.e., the frequency of the zero "z" may not be exactly the same as the frequency of the output pole "p2". However, a zero "z" close to the output pole "p2" is sufficient, so long as the operation of the voltage regulator 102, after being compensated by the compensation circuit 104, is stable.

Further, as shown in FIG. 2, besides the zero "z", the compensation circuit 104 also introduces a third pole "p3" into the Bode plot of the voltage regulator 102. Consistent with embodiments of the present disclosure, the compensation circuit 104 is configured such that the third pole "p3" is near a unity gain frequency, i.e., the frequency at which the gain is one (or 0 dB as shown in FIG. 2). Under this condition, as shown in the lower pane of FIG. 2, a phase margin of the voltage regulator 102 is larger than 0, and hence the voltage regulator 102 can operate stably. According to the disclosure, a relative distance between the locations of the zero "z" and the output pole "p2" may be designed to allow the phase margin of the voltage regulator 102 to be larger than 0, so as to realize stable operation.

As described above, the compensation transistor 122 functions as a variable resistor in the compensation circuit 104 and the resistance of the compensation transistor 122 can be controlled by varying the bias voltage applied to the gate of the compensation transistor 122. This bias voltage is also referred to as a compensation bias voltage or a compensation control signal, and is designated herein as $V_{bias}$. As shown in FIG. 1, the compensation control circuit 106 is coupled to the gate of the compensation transistor 122 and configured to provide the compensation bias voltage $V_{bias}$ to the compensation transistor 122.

Referring to FIG. 1, the compensation control circuit 106 includes a current sensor 124, a current scaling circuit 126, and a bias voltage generator 128. The bias voltage generator 128 is also referred to as a compensation control signal generator. In the example shown in FIG. 1, the current sensor 124 includes a PMOS transistor coupled between the power supply 114 and the current scaling circuit 126. The current scaling circuit 126 is further coupled to the ground 116 and includes a current mirror structure formed by a first NMOS transistor 126-1 and a second NMOS transistor 126-2. The bias voltage generator 128 includes a PMOS transistor coupled between the LDO output terminal 118 and the current scaling circuit 126, and between the LDO output terminal 118 and the compensation circuit 104. The current flowing in the pass transistor 110 includes two components, $I_{load}$ and $I_r$, where $I_{load}$ is the output load current that flows in the load of the semiconductor device 100 and $I_r$ is the current that flows in the first resistor 112-1 of the voltage divider 112. According to the present disclosure, $I_r=V_{FB}/R_{112\text{-}1}=V_{REF}/R_{112\text{-}1}$, where $R_{112\text{-}1}$ is the resistance of the first resistor 112-1.

Consistent with embodiments of the present disclosure, the current sensor 124 responses to a variation of the load current $I_{load}$ to generate a sensed current $I_{sense}$ passing through the current sensor 124. The sensed current $I_{sense}$ is mirrored by the current scaling circuit 126 and fed to the bias voltage generator 128. The bias voltage generator 128 generates the compensation bias voltage $V_{bias}$ according to the sensed current $I_{sense}$, and hence according to the load current $I_{load}$, and applies the compensation bias voltage $V_{bias}$ to the gate of the compensation transistor 122. Specifically, the bias voltage generator 128 is coupled between a drain or source terminal of the compensation transistor 122 and a gate terminal of the compensation transistor 122. In the example shown in FIG. 1, the bias voltage generator 128 includes a transistor and is connected in a diode-connected configuration, that is, a drain terminal and a gate terminal of the transistor in the bias voltage generator 128 are coupled to each other. Accordingly, when the load current $I_{load}$ changes, the output of the bias voltage generator 128, i.e., the compensation bias voltage $V_{bias}$, also changes. As such, the zero generated by the compensation circuit 104 tracks the output pole at the output stage of the voltage regulator 102, i.e., the zero and the output pole are at the same or approximately the same frequency, such that the phase margin of the voltage regulator 102 is larger than 0.

Specifically, the compensation bias voltage $V_{bias}$ can be expressed as follows:

$$V_{bias}=V_{OUT}-V_{gs}=V_{OUT}-V_{tp}-V_{ov}$$

where $V_{gs}$, $V_{tp}$, and $V_{ov}$ are the source-gate voltage, the threshold voltage, and the overdrive voltage, respectively, of the PMOS transistor in the bias voltage generator 128. The overdrive voltage $V_{ov}$ depends on the sensed current $I_{sense}$. When the load current $I_{load}$ increases, the frequency of the output pole of the voltage regulator 102 increases. However, when $I_{load}$ increases, the sensed current $I_{sense}$ and hence the overdrive voltage $V_{ov}$ of the PMOS transistor in the bias voltage generator 128 also increase. Thus the compensation bias voltage $V_{bias}$ decreases. As a result, the resistance of the compensation transistor 122 decreases, which "pushes" the inserted zero to a higher frequency to track the output pole.

In the example shown in FIG. 1, the bias voltage generator 128 is coupled between the LDO output terminal 118 and the compensation circuit 104. For example, as shown in FIG. 1, the bias voltage generator 128 is directly coupled between the LDO output terminal 118 and the compensation circuit 104, without other components (except wirings) between the bias voltage generator 128 and the LDO output terminal 118 or between the bias voltage generator 128 and the compensation circuit 104. More particularly, the source of the PMOS transistor in the bias voltage generator 128 is directly coupled to the LDO output terminal 118, and the drain and the gate of the PMOS transistor in the bias voltage generator 128 are directly coupled to the gate of the compensation transistor 122 of the compensation circuit 104. With this configuration, the compensation bias voltage $V_{bias}$ is generated directly from the output of the voltage regulator 102.

As a result, the compensation bias voltage $V_{bias}$ is not affected by other factors, such as voltage fluctuation at the power supply 114, and is thus more stable.

Consistent with embodiments of the present disclosure, the pass transistor 110, which is provided as a MOSFET in the example shown in FIG. 1, is configured to output a current to the load. On the other hand, the current sensor 124, which is also provided as a MOSFET in the example shown in FIG. 1, is configured to sense the load current $I_{load}$ to generate the sensed current $I_{sense}$, i.e., the current sensor 124 does not provide the load with a current. Therefore, the size of the transistor used as the current sensor 124 can be smaller than the size of the pass transistor 110.

Figure 3:
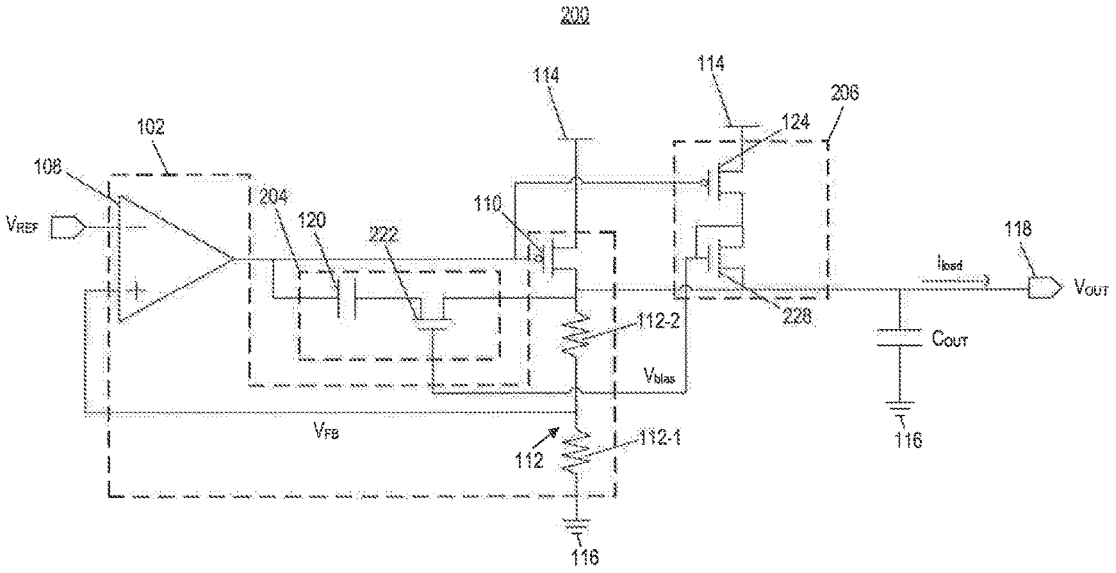
FIGS. 3-13 are circuit diagrams of semiconductor devices according to other exemplary embodiments.

FIG. 3 shows another exemplary semiconductor device 200 consistent with embodiments of the present disclosure. The semiconductor device 200 includes the voltage regulator 102, a compensation circuit 204, and a compensation control circuit 206. The compensation circuit 204 shown in FIG. 3 is similar to the compensation circuit 104 shown in FIG. 1, except that the compensation circuit 204 includes an NMOS transistor as a compensation transistor 222. The compensation control circuit 206 includes an NMOS transistor as a bias voltage generator 228 instead of a PMOS transistor, and does not have a current scaling circuit. That is, in the compensation control circuit 206, the current sensor 124 is directly coupled to the bias voltage generator 228. Thus, the current sensed by the current sensor 124 is directly fed to the bias voltage generator 228 without being mirrored. Similar to that in the semiconductor device 100, the bias voltage generator 228 in the semiconductor device 200 is directly coupled between the LDO output terminal 118 and the compensation circuit 204, as shown in FIG. 3.

Figure 4:
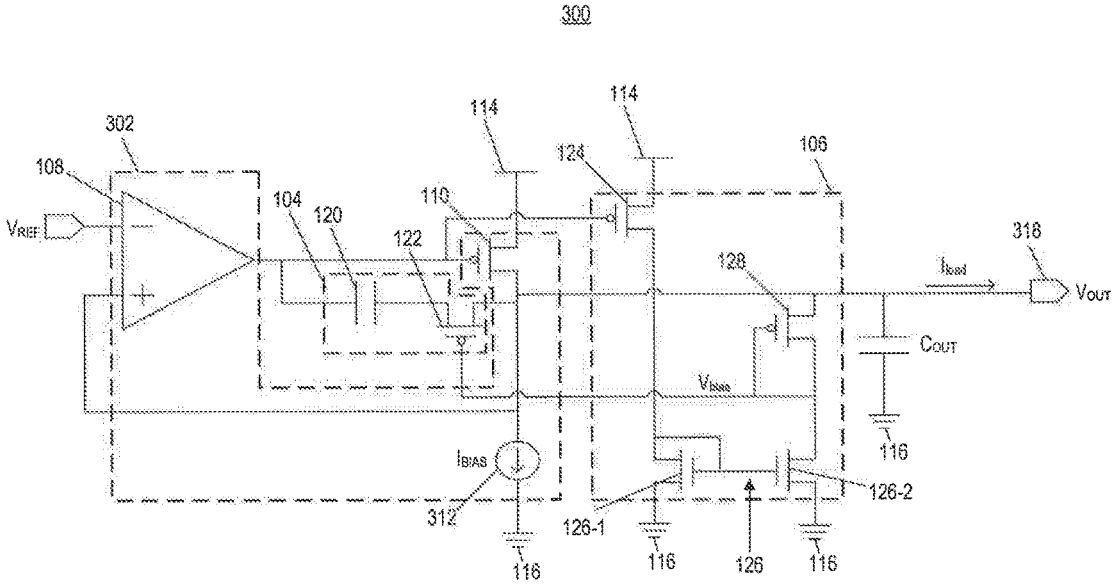

The compensation circuit and the compensation control circuit consistent with embodiments of the present disclosure can be used to compensate not only a voltage regulator as described above, but also other devices containing an amplifier. FIG. 4 shows another exemplary semiconductor device 300 consistent with embodiments of the present disclosure. The semiconductor device 300 is similar to the semiconductor device 100, except that the semiconductor device 300 includes a unity gain buffer 302 instead of the voltage regulator 102. As shown in FIG. 4, the unity gain buffer 302 has a similar structure as the voltage regulator 102 but includes a current bias 312 instead of the voltage divider 112. An output terminal 318 of the unity gain buffer 302 is coupled to the positive input terminal of the error amplifier 108. The output terminal 318 is also referred to as a "buffer output terminal." Similar to that in the semiconductor device 100, the bias voltage generator 128 in the semiconductor device 300 is directly coupled between the buffer output terminal 318 and the compensation circuit 104.

Figure 5:
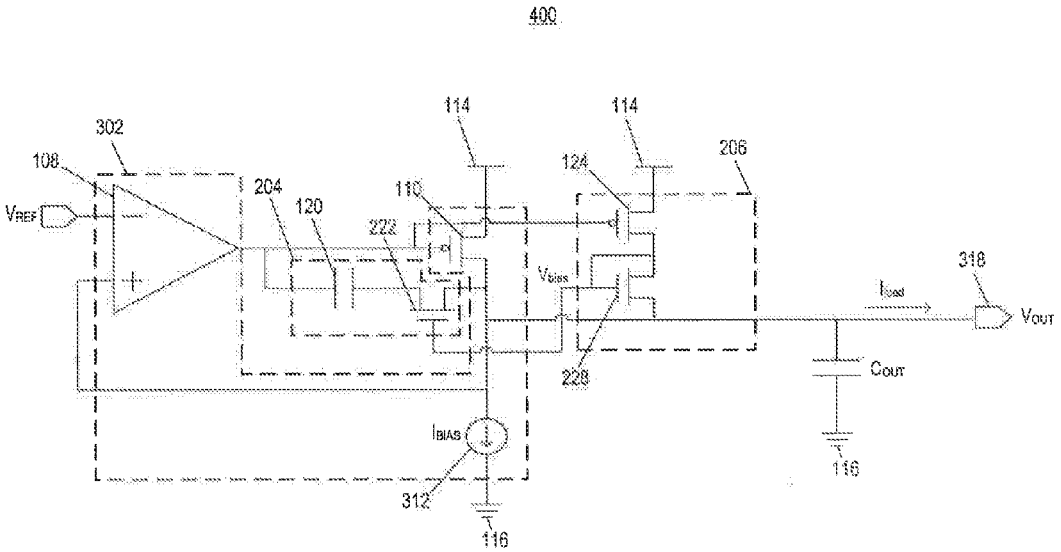

FIG. 5 shows another exemplary semiconductor device 400 consistent with embodiments of the present disclosure. The semiconductor device 400 is similar to the semiconductor device 300, but, like the semiconductor device 200, includes the compensation circuit 204 and the compensation control circuit 206 instead of the compensation circuit 104 and the compensation control circuit 106. In the semiconductor device 400, the bias voltage generator 228 is also directly coupled between the buffer output terminal 318 and the compensation circuit 204.

Figure 6:
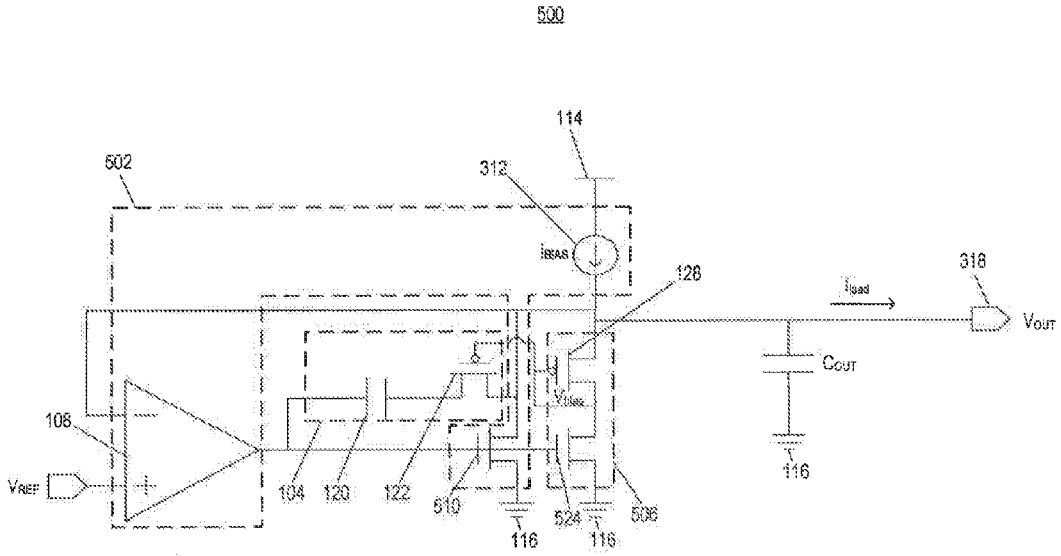

FIG. 6 shows another exemplary semiconductor device 500 consistent with embodiments of the present disclosure. The semiconductor device 500 includes a unity gain buffer 502, the compensation circuit 104, and a compensation control circuit 506. As shown in FIG. 6, the unity gain buffer 502 includes an NMOS transistor as a pass transistor 510, rather than the PMOS transistor in the unity gain buffer 302. In the unity gain buffer 502, the positive input terminal of the error amplifier 108 is coupled to the reference voltage $V_{REF}$ and the negative input terminal of the error amplifier 108 is coupled to the buffer output terminal 318.

As shown in FIG. 6, the compensation control circuit 506 includes a current sensor 524 and the bias voltage generator 128. The current sensor 524 is configured to sense the load current $I_{load}$ to generate the sensed current $I_{sense}$, and includes an NMOS transistor. The bias voltage generator 128 is configured to generate the compensation bias voltage $V_{bias}$ based on the sensed current $I_{sense}$. In the example shown in FIG. 6, the current sensor 524 and the bias voltage generator 128 are directly coupled to each other without a current scaling circuit in between. Moreover, the bias voltage generator 128 is also directly coupled between the buffer output terminal 318 and the compensation circuit 104.

Figure 7:
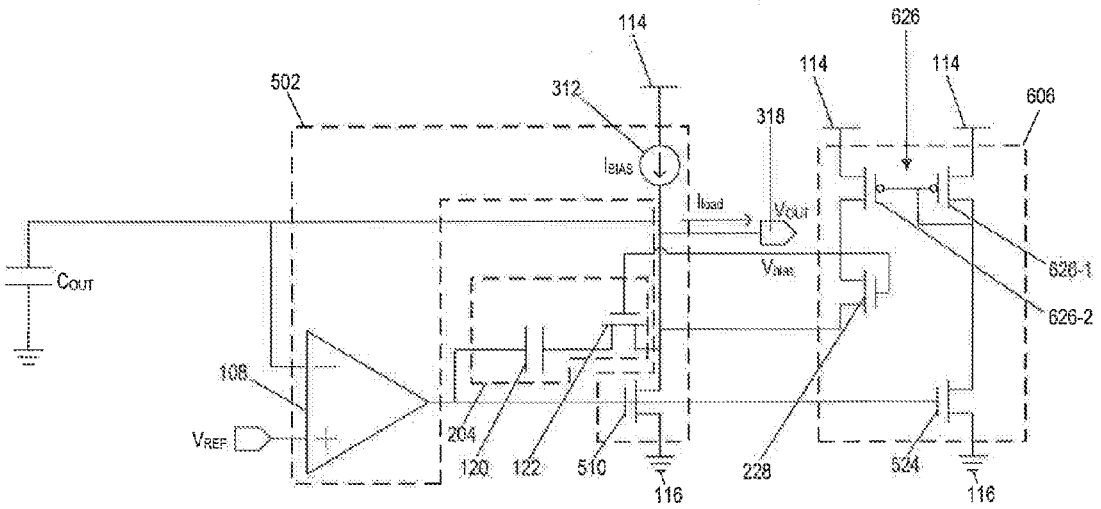

FIG. 7 shows another exemplary semiconductor device 600 consistent with embodiments of the present disclosure. The semiconductor device 600 is a "mirror" of the semiconductor device 300. That is, all the PMOS transistors in the semiconductor device 300 are replaced by NMOS transistors in the semiconductor device 600. Correspondingly, all the NMOS transistors in the semiconductor device 300 are replaced by PMOS transistors in the semiconductor device 600. Specifically, the semiconductor device 600 includes the unity gain buffer 502, the compensation circuit 204, and a compensation control circuit 606. The unity gain buffer 502 and the compensation circuit 204 are described above and thus details thereof are omitted here.

The compensation control circuit 606 includes the current sensor 524 having an NMOS transistor, the bias voltage generator 228 having an NMOS transistor, and a current scaling circuit 626. The current scaling circuit 626 includes a current mirror structure formed by a first PMOS transistor 626-1 and a second PMOS transistor 626-2. In the semiconductor device 600, the bias voltage generator 228 is also directly coupled between the buffer output terminal 318 and the compensation circuit 204.

FIGS. 8-11 show other exemplary semiconductor devices 700, 800, 900, and 1000, respectively, consistent with embodiments of the present disclosure. The semiconductor devices 700, 800, 900, and 1000 are similar to the semiconductor device 100, except that the compensation circuit in each of these semiconductor devices further includes one or more impedance devices. An impedance device according to the present disclosure can be a resistor, a capacitor, or an inductor, or an electrically coupled combination of two or more thereof. The one or more impedance devices are added into the semiconductor device 700, 800, 900, or 1000 to modify the location of the inserted zero.

Figure 8:
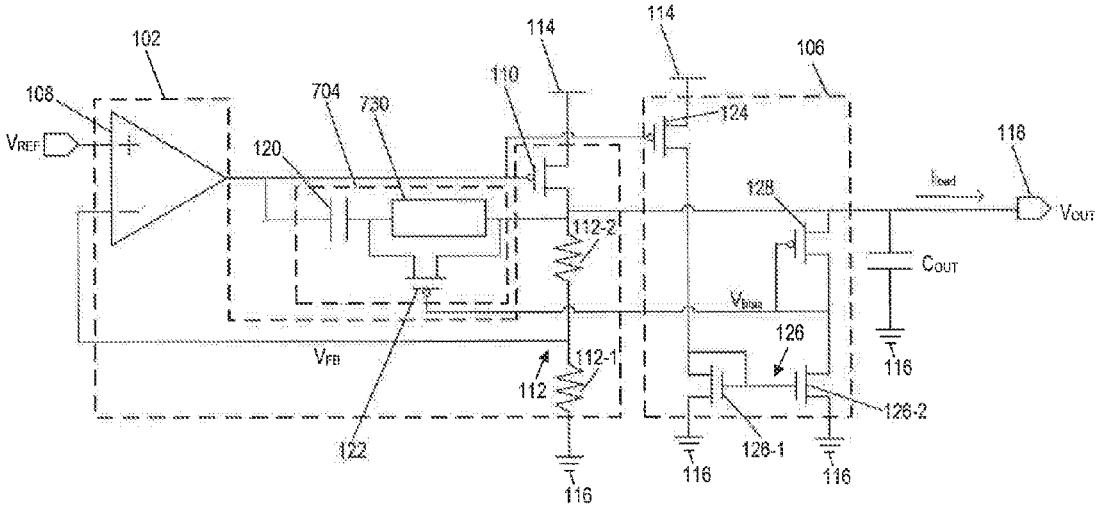

Specifically, as shown in FIG. 8, the semiconductor device 700 includes a compensation circuit 704 having a parallel impedance device 730 connected in parallel with the compensation transistor 122. When the output terminal 118 is floating, that is, when the output terminal 118 is not connected to the load, the compensation transistor 122 is disabled, i.e., switched OFF. In such a situation, the parallel impedance device 730, such as a resistor, can still provide a path for the compensation capacitor 120.

Figure 9:
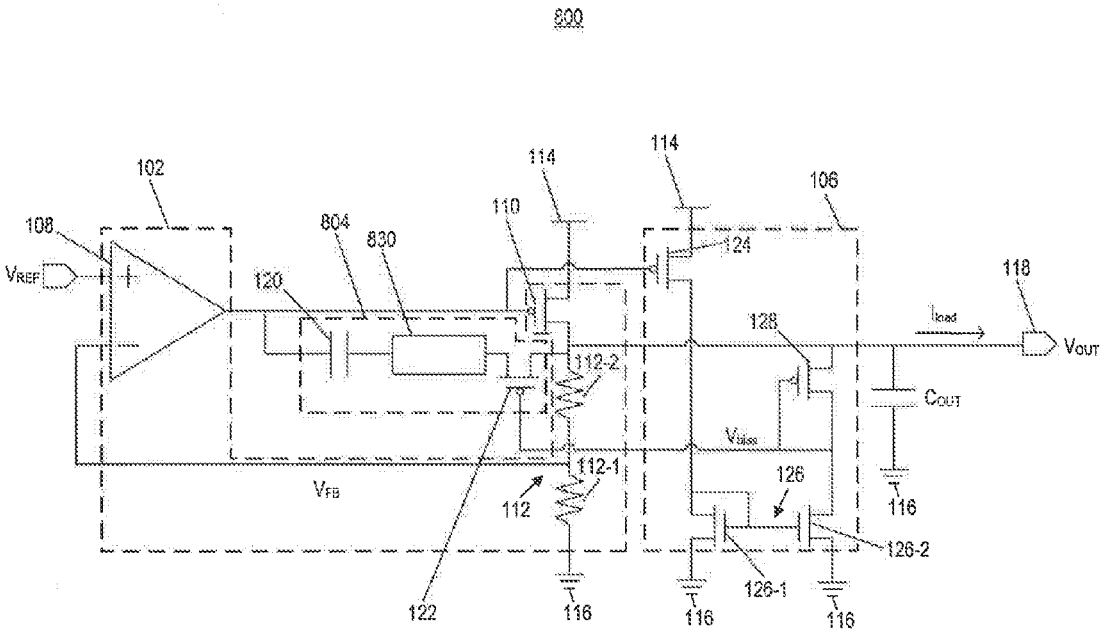
Figure 10:
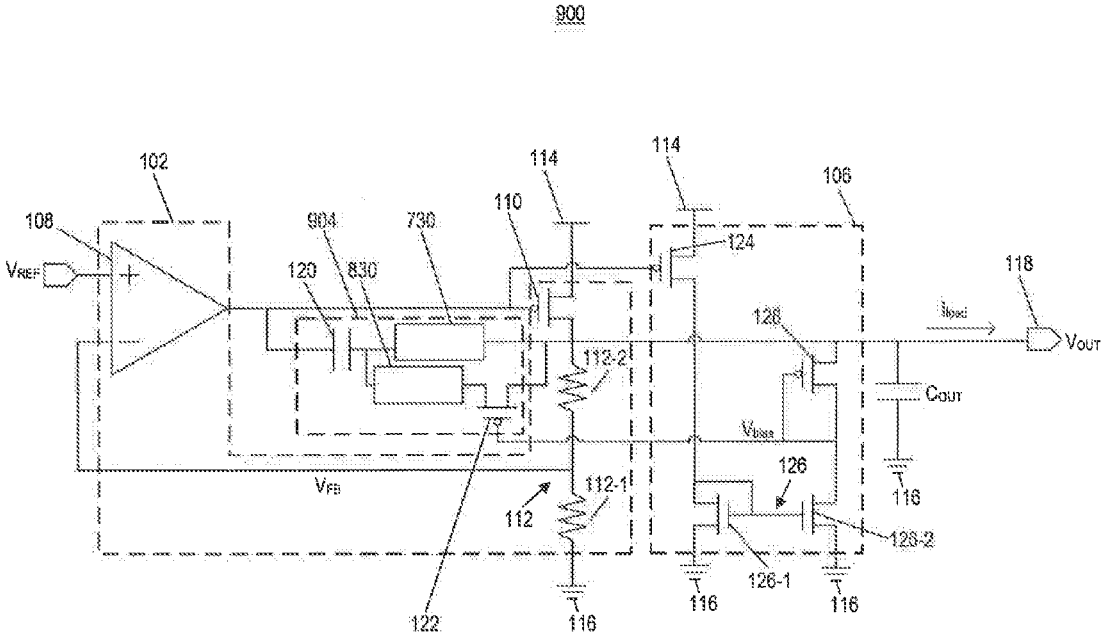
Figure 11:
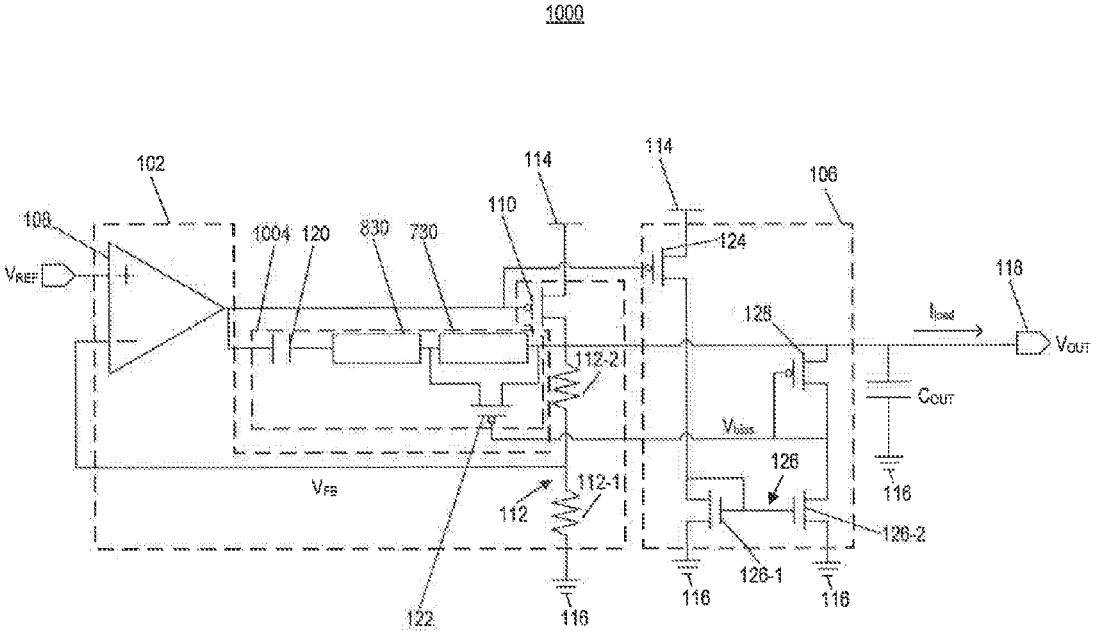

As shown in FIG. 9, the semiconductor device 800 includes a compensation circuit 804 having a series impedance device 830 connected in series with the compensation transistor 122. As shown in FIG. 10, the semiconductor device 900 includes a compensation circuit 904 having both the parallel impedance device 730 and the series impedance device 830. In the semiconductor device 900, the series impedance device 830 is connected in series with the compensation transistor 122, and the parallel impedance device 730 is connected in parallel with the compensation transistor 122 and the series impedance device 830. As shown in FIG. 11, the semiconductor device 1000 includes a compensation circuit 1004 also having both the parallel impedance device 730 and the series impedance device 830. In the semiconductor device 1000, the parallel impedance device 730 is connected in parallel with the compensation transistor 122, and the series impedance device 830 is connected in series with the compensation transistor 122 and the parallel impedance device 730. According to the present disclosure, each of the impedance devices 730 and 830 can be a resistor, a capacitor, or an inductor, or an electrically coupled combination of two or more thereof.

Figure 12:
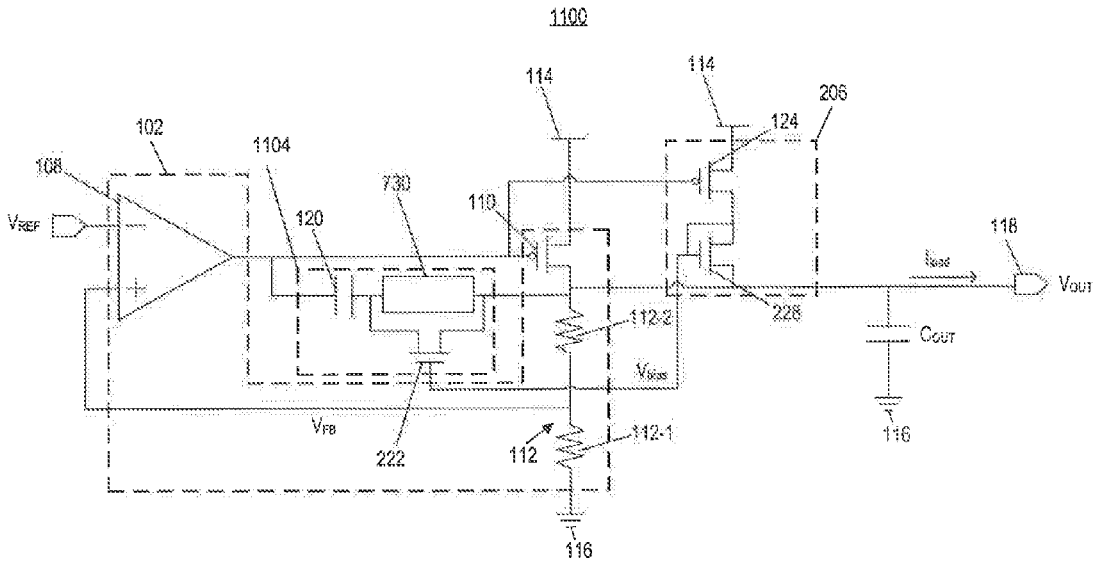
Figure 13:
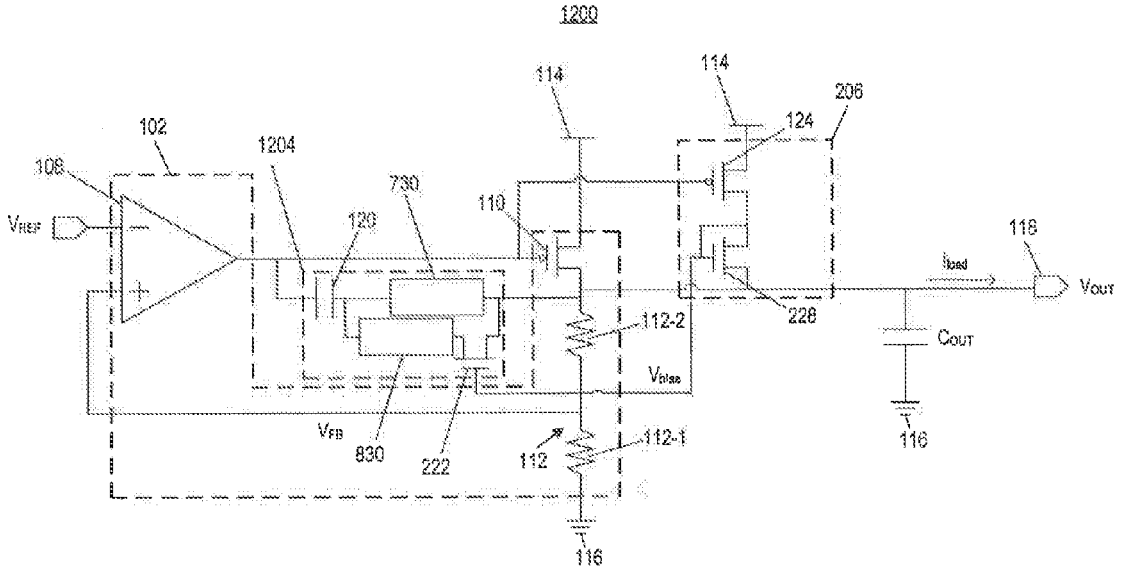

FIGS. 12 and 13 show additional exemplary semiconductor devices 1100 and 1200, respectively, consistent with embodiments of the present disclosure. As shown in FIG. 12, the semiconductor device 1100 is similar to the semiconductor device 200, except that the semiconductor device 1100 includes a compensation circuit 1104, which, similar to the compensation circuit 704 in the semiconductor device 700, has the parallel impedance device 730 coupled between the source and drain of the compensation transistor 222, i.e., connected in parallel with the compensation transistor 222. Similarly, as shown in FIG. 13, the semiconductor device 1200 is similar to the semiconductor device 200, except that the semiconductor device 1200 includes a compensation circuit 1204, which, similar to the compensation circuit 904 in the semiconductor device 900, has the parallel impedance device 730 and the series impedance device 830. In the semiconductor device 1200, the series impedance device 830 is connected in series with the compensation transistor 222, and the parallel impedance device 730 is connected in parallel with the compensation transistor 222 and the series impedance device 830.

In the embodiments described above, the load variation is detected by detecting the variation of the load current. The impedance value of a compensation circuit, such as the compensation circuit 104, 204, 704, 804, 904, 1004, 1104, or 1204, can be adjusted according to the varied load current sensed by a current sensor, such as the current sensor 124 or 524. In some embodiments, the load variation may be detected by detecting the variation of the load voltage, i.e., by sensing a varied load voltage using a voltage sensor. In this scenario, the impedance value of the compensation circuit may be adjusted using, for example, a voltage divider, based on the varied load voltage.

According to the present disclosure, as discussed above, a bias voltage generator, such as the bias voltage generator 128 or 228, is coupled between a gate terminal and a source terminal of a compensation transistor, such as the compensation transistor 122 or 222, and is configured to generate a compensation control signal to adjust an impedance of the compensation transistor based on the sensed load current. Therefore, the voltage across the gate terminal and the source terminal of the compensation transistor can be directly controlled by the bias voltage generator without being affected by other disturbances, such as a variation of the power supply.

Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A semiconductor device, comprising:

an amplifier having an output terminal;

a pass transistor having a gate and an output terminal, the gate being coupled to the output terminal of the amplifier, and the output terminal of the pass transistor being coupled to a load;

a compensation circuit coupled between the output terminal of the amplifier and the output terminal of the pass transistor, the compensation circuit having a variable impedance, the compensation circuit comprising a compensation transistor coupled between a capacitor and the output terminal of the pass transistor; and a bias voltage generator directly coupled between the output terminal of the pass transistor and the compensation circuit.

2. The semiconductor device according to claim 1, wherein:

the compensation circuit includes:

a variable impedance device; and a capacitor connected in series with the variable impedance device, and the bias voltage generator is configured to generate a bias voltage to adjust an impedance of the variable impedance device.

3. The semiconductor device according to claim 2, wherein the variable impedance device includes a variable resistor.

4. The semiconductor device according to claim 3, wherein:

the variable resistor includes a compensation transistor, and a gate of the compensation transistor is coupled to the bias voltage generator to receive the bias voltage.

5. The semiconductor device according to claim 4, wherein:

the bias voltage generator includes a signal generating transistor, a gate of the signal generating transistor is coupled to one of a source or drain of the signal generating transistor and is further coupled to the gate of the compensation transistor, and the other one of the source or drain of the signal generating transistor is coupled to the output terminal of the pass transistor.

6. The semiconductor device according to claim 5, wherein the compensation transistor and the signal generating transistor are both p-channel metal-oxide-semiconductor (PMOS) transistors or are both n-channel metal-oxide-semiconductor (NMOS) transistors.

7. The semiconductor device according to claim 2, wherein the variable impedance device includes one of a variable capacitor or a variable inductor.

8. The semiconductor device according to claim 2, wherein the compensation circuit further includes a parallel impedance device connected in parallel with the variable impedance device.

9. The semiconductor device according to claim 8, wherein the compensation circuit further includes a series impedance device connected in series with the parallel impedance device and the variable impedance device.

10. The semiconductor device according to claim 9, wherein the parallel impedance device and the series impedance device each include one of a resistor, a capacitor, or an inductor.

11. The semiconductor device according to claim 2, wherein the compensation circuit further includes a series impedance device connected in series with the variable impedance device.

12. The semiconductor device according to claim 11, wherein the compensation circuit further includes a parallel impedance device connected in parallel with the series impedance device and the variable impedance device.

13. The semiconductor device according to claim 1, further comprising:

a current sensor coupled to the gate of the pass transistor and configured to sense a load current of the load.

14. The semiconductor device according to claim 13, wherein the current sensor includes a sensing transistor, a gate of the sensing transistor being coupled to the gate of the pass transistor.

15. The semiconductor device according to claim 13, further comprising:

a current mirror coupled between the current sensor and the bias voltage generator.

16. The semiconductor device according to claim 1, further comprising:

a voltage divider coupled to the output terminal of the pass transistor, the voltage divider including a first resistor and a second resistor connected in series, wherein a mid point between the first and second resistors is coupled to an input terminal of the amplifier.

17. The semiconductor device according to claim 1, wherein the output terminal of the pass transistor is coupled to an input terminal of the amplifier.

18. A semiconductor device, comprising:

an amplifier;

a pass transistor, a gate of the pass transistor being coupled to an amplifier output terminal of the amplifier, and one of a source or drain of the pass transistor being coupled to a device output terminal of the semiconductor device;

a compensation transistor coupled between a capacitor and the device output terminal, the capacitor being coupled to the amplifier output terminal;

a current sensor coupled to the gate of the pass transistor and configured to sense a load current of the semiconductor device; and a bias voltage generator directly coupled between the device output terminal and a gate of the compensation transistor, the bias voltage generator being configured to generate a compensation control signal to adjust a resistance of the compensation transistor based on the sensed load current.

19. The semiconductor device according to claim 18, wherein the source of the compensation transistor is coupled to the device output terminal and a drain of the compensation transistor is coupled to the amplifier output terminal.

20. The semiconductor device according to claim 19, wherein the bias voltage generator includes a bias voltage generating transistor in a diode-connected configuration, a gate and one of a source or drain of the bias voltage generating transistor being coupled to the gate of the compensation transistor, and the other one of the source or drain of the bias voltage generating transistor being coupled to the source of the compensation transistor.

* * * * *